US005092071A

United States Patent [19]

Moore

[11] Patent Number: 5,092,071

[45] Date of Patent: Mar. 3, 1992

[54] WEAPON ACCESSORY MOUNT

[76] Inventor: Larry Moore, c/o Adventurer's Outpost, P.O. Box 70, Cottonwood, Ariz. 86326

[21] Appl. No.: 668,583

[22] Filed: Mar. 13, 1991

[51] Int. Cl.[5] ..... F41C 27/00; F41C 27/06

[52] U.S. Cl. ..... 42/85; 42/86; 42/103; 42/105

[58] Field of Search ..... 42/75.01, 85, 86, 100, 42/101, 103, 105; 124/87–89; 362/110–114

[56] References Cited

U.S. PATENT DOCUMENTS 1,215,171 2/1917 Lewis ..... 42/103
2,103,539 12/1937 Kuhn ..... 42/101
2,449,551 9/1948 Garand ..... 42/101
4,026,054 5/1977 Snyder ..... 42/103
4,542,447 9/1985 Quakenbush ..... 42/103
4,774,754 12/1986 Reynolds, Jr. ..... 42/103
4,856,218 8/1989 Reynolds, Jr. ..... 42/103
4,934,086 6/1990 Houde-Walter ..... 42/103

*Primary Examiner*—Charles T. Jordan

[57] ABSTRACT

An accessory mount particularly well suited to a broad variety of weapons (e.g., Heckler & Koch firearms) comprises a plug portion that fits within the weapon accessory mounting hole and is radially expanded, e.g., by means of an interior mandrel, to provide large area, high friction, robust engagement between the plug and the mounting hole. A second portion for holding an accessory (e.g., a laser sight) is coupled to the plug by an alignment means and a hand operated screw or lock so that the accessory is easily removed and reinstalled in the same position relative to the weapon boresight without need for recalibration.

20 Claims, 3 Drawing Sheets

FIG. 6A
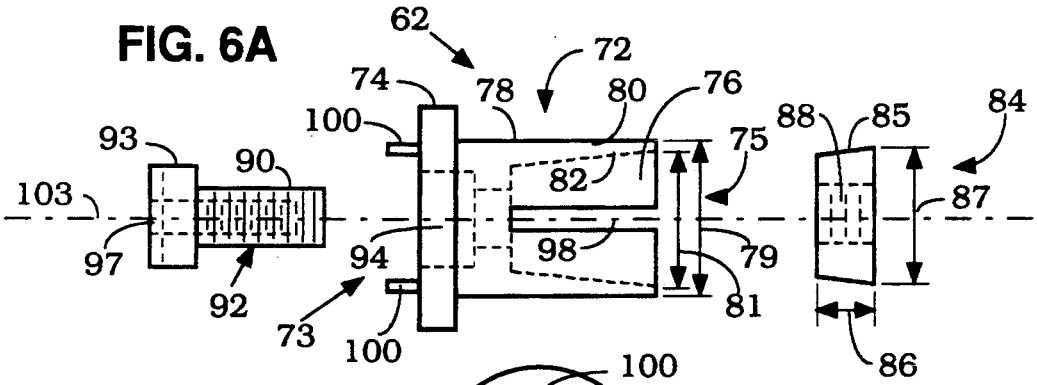
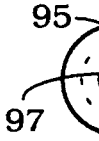
FIG. 6B
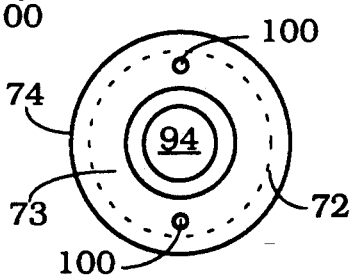
FIG. 6C
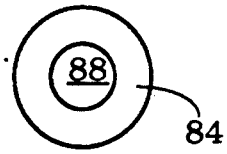
FIG. 6D
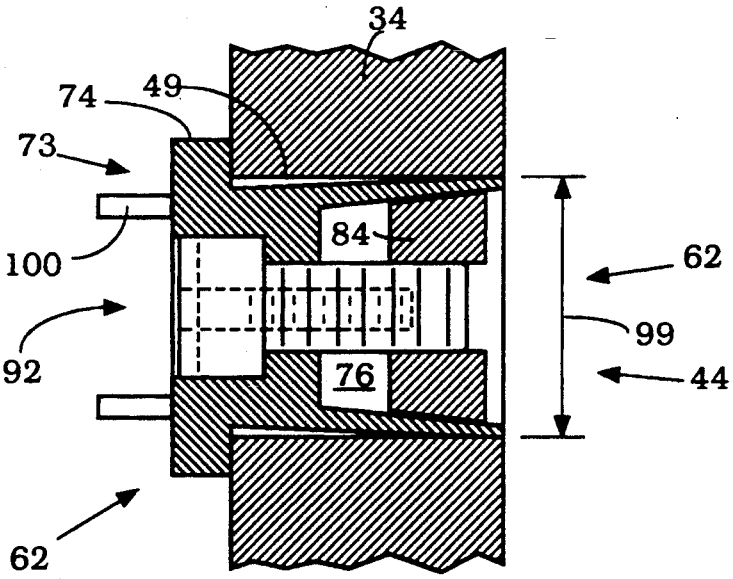
FIG. 7

WEAPON ACCESSORY MOUNT

FIELD OF THE INVENTION

The present invention concerns an improved means and method for attaching accessories to weapons.

BACKGROUND OF THE INVENTION

It is common place with weapons to mount various accessories to the barrel, receiver, stock, bow, handle or other portions of the weapon. Examples of such accessories are scopes, laser marker sights, night lights, night vision devices, ammunition holders, slings and bayonets. In the case of various sighting devices it is essential that they be rigidly mounted so that once the sight is aligned to correspond to the weapon boresight, the sight cannot move. Otherwise, the projectile fired from the weapon will not hit the target on which the sight is fixed. This is true of rifles, pistols, shotguns, bows, crossbows, launchers and other aimable weapons.

Some weapon manufacturers provide standard accessory mounting points as a part of their weapons. FIG. 1 is a simplified side view of a weapon, in this example, a rifle of the type sold by Heckler & Koch (hereafter abbreviated as H&K). H&K weapons are well known and distributed in the USA by the Heckler & Koch Company of Chantily, Va. and by numerous other licensees or representatives elsewhere in the world.

Referring to FIG. 1, weapon 10 comprises barrel 12, breech 14, loading and trigger assembly 16, fire rate selector 18, trigger 20, magazine 22, handgrip 24, shoulder stock 26, stock forepiece 28, charging slide 30, rear sight 32 and combined front sight and accessory mount 34 containing front sight post 36. Accessory mount 34 is rigidly attached to barrel 12.

Arrow 38 indicates the boresight of the weapon, that is, the path followed by the bullet. Laser target marker 40 is attached to accessory mount 34 in hole 44. Laser target marker 40, typically referred to as a laser sight, produces a small diameter intense light beam indicated by arrow 42 directed along the line of fire of the weapon. When light beam 42 intersects an object a bright spot is visible showing where the bullet will strike, provided that light beam 42 has been properly aligned with boresight 38. If laser sight 40 emits visible light, then the weapon user can usually see the light spot with the unaided eye. If the laser sight operates in the infra-red, then a night vision viewer is needed. Laser sights have the advantage compared to conventional iron or telescopic sights, that the shooter's peripheral vision is unobstructed and the light spot is easy to see under low light conditions.

It is highly desirable that laser sight 40 be rigidly mounted to weapon 10 so that handling and occasional bumps during use do not disturb the alignment between light beam 42 and weapon boresight 38. This is because the process of aligning beam 42 to boresight 38 is time consuming and may involve repeatedly firing the weapon under carefully controlled conditions, as for example from a firing bench. Alignment of the sight is often difficult or impossible under field conditions when the shooter may be dependent upon the correct sight-weapon alignment for his safety and survival. Even very small angular displacements of a laser sight can cause significant aiming errors. For example, an angular displacement of only 0.1 degree, causes an aiming error of 17 cm (about 7 inches) at a range of 100 meters. Thus, the assembly used to mount the laser sight or other alignment critical accessory to the weapon attachment point must be very robust, i.e., comparatively insensitive to bumps, knocks, vibration and shock.

It is desirable that the accessory be able to be easily and quickly removed and reinstalled on weapon 10 without any need for realignment or recalibration. For example, it may be necessary to remove a laser sight to change batteries or make other adjustments or to temporarily mount a different accessory. The sight holder should detach quickly and easily from the weapon without use of tools and when reattached to the weapon return the sight to the same relative position so that light beam 42 and boresight 38 are properly realigned.

It is also desirable that the holder be able to accommodate a variety of weapon accessories so that the same mounting assembly can serve multiple purposes. It is further desirable that the accessory mounting assembly not require any modification of the weapon, that is, it must attach to the weapon as it comes from the supplier without need for providing extra holes or grooves or other attachment points.

While prior art mounting assemblies permit various accessories (e.g., laser sights, flashlights) to be attached to weapons, such mounting assemblies have various deficiencies well known in the art. For example, they may allow an undesirable degree of relative movement of the accessory relative to the weapon boresight, or they may not return the accessory to a predetermined position after disassembly, or they may require special tools to change the accessory, or they may not be sufficiently robust to withstand bumps, knocks or repeated firing shock, or a combination of the above.

FIG. 2 shows an exploded view of standard H&K mount 34 equipped with a prior art laser sight 40. Accessory mount 34 is partially cut away in FIG. 2 to show cylindrical accessory mounting hole 44 therein. A front view of accessory mount 34 (i.e., looking along barrel 12 toward stock 26) is shown in FIG. 3. Laser sight 40 has lens 46 through which light beam 42 is emitted and cylindrical mounting plug 48 which mates with hole 44 in accessory mount 34. Plug 48 is retained in hole 44 by set screw 50 passing through existing side hole 52 in accessory mount 34. Holes 44 and 52 are standard holes provided by H&K in accessory mount 34.

There are differences in the size of holes 44 and 52 from weapon to weapon as a result of normal manufacturing variation. If plug 48 is to be able to fit weapons having the same nominal mounting hole size, some clearance amount must be provided between plug 48 and hole 44. Thus, plug 48 will be loose in some mounting holes and tight in others. This clearance amount permits angular displacement of plug 48 in mounting hole 44 and possible misalignment of the sight. Further, if plug 48 is anchored in hole 44 using a set screw passing through existing side hole 52, as shown for example in FIG. 3, plug 48 is off-center in hole 44 by clearance amount 54, and there is only limited contact area between outer surface 47 of plug 48 and inner surface 49 of hole 44. Thus, laser sights and other accessories mounted in this fashion are not as robust as is desired. Further, the small contact area between the set screw and hole 52 make it difficult to repeatably remount the accessory in a precisely determined position. Accordingly, a need continues to exist for improved accessory mounting means and methods for weapons.

The description herein refers to "weapons" and to "bullets" and illustrates the various concepts in terms of a firearm having a particular mounting hole arrangement. However, this is merely for convenience of explanation and not intended to be limiting, and as used herein, "weapon(s)" is intended to refer to any form of aimable weapon, including but no&: limited to firearms, air operated arms, bows, crossbows, grenade or missile launchers, rifles, pistols, shotguns, and so forth, and "bullet(s)" is intended to refer to any form of projectile, including but not limited to arrows, bolts, bullets, missiles, grenades, and so forth.

SUMMARY OF THE INVENTION

The present invention provides a weapon accessory mounting assembly adapted to install securely in a standard weapon accessory mounting hole of predetermined inner diameter and depth, and comprises in its broadest form, a radially expandable plug for demountably gripping the inner surface of the mounting hole, and an accessory holder coupled to the plug in separable predetermined relationship. The expandable plug is rigidly clamped in the weapon mounting hole and the accessory holder is removably mounted thereon. This combination provides a robust but convenient mounting assembly. Accessories may be removed and reinstalled without special tools and reliably returned to a predetermined location relative to the boresight.

In a preferred embodiment and in greater detail, the predetermined relationship between the plug and holder is determined by an alignment means extending between the two, as for example but not limited to, alignment pins or keys which engage mating holes or grooves. The mating alignment means insures that the relative position of the holder and plug are precisely determined.

In a preferred embodiment and in still greater detail, a hand operable means is provided for attaching and detaching the plug and holder without use of tools. A knurled knob thumb screw is suitable. Detents are desirably employed in connection with the thumb screw to provide positive, temporary, rotation stops to inhibit unintended loosening of the thumb screw by vibration, shock or other means.

In a preferred embodiment and in further detail, the plug means is hollow with a cavity extending therein from a first end thereof. The thin wall surrounding the cavity is radially expandable to provide a substantial contact with the interior bore of the mounting hole. In still further detail, a spreading mandrel, for example in the shape of a thick washer and desirably having a tapered periphery, is drawn into the cavity, for example by a threaded screw, to radially expand the plug wall so that it grips the interior bore of the mounting hole at multiple locations around its circumference. This provides robust, high friction attachment of the plug to the weapon mount. Once the mandrel has been tightly seated, great force is required to move the plug in the hole.

In a preferred embodiment and in yet greater detail, the sidewall of the plug is made expandable by providing longitudinal slits therein extending part way along the length of the plug, at least one, and preferably three to six or more. The inside surface of the cavity sidewall is desirably tapered so that the cavity becomes narrower in a direction away from the cavity opening. The radial periphery of the mandrel is also desirably tapered to match the interior taper of the cavity. When the mandrel is drawn into the cavity the plug sidewall expands to grip the interior surface of the mounting hole. The taper is conveniently about one degree.

In a preferred embodiment and in still further detail, the mandrel is drawn into the cavity by an axially oriented mandrel screw which has a male thread that engages a female thread in the mandrel. At the other end of the mandrel screw is a shoulder that bears against the face of the plug opposite the cavity. Thus, turning the mandrel screw draws the mandrel into the cavity of the plug and expands the plug sidewall to substantially uniformly (except for the slits) grip the inside of the mounting hole adjacent the mandrel. This provides a very positive, tight, robust high friction lock between the plug and the mounting hole. While it is preferable that the screw threads be male and the mandrel threads be female, they may be reversed.

The accessory mounting assembly is attached to the weapon by inserting the plug into the mounting hole and radially expanding the plug and then attaching the accessory holder thereto in predetermined orientation. This is accomplished for example by tightening the mandrel screw to draws the mandrel into the plug cavity to expand the plug sidewalls radially to grip the interior of the mounting hole.

The desired angular orientation of the accessory holder around the weapon boresight is established before the plug sidewall is expanded. This is accomplished by temporarily placing the holder in place with the alignment means between the plug and holder engaged. The plug is rotated in the mounting hole until the holder has the desired angular orientation with respect to the weapon viewed looking along the barrel. The holder is removed from the alignment keys without disturbing the plug and then the plug expanded. A screw driver is conveniently used for this portion of the operation.

The holder with the accessory attached thereto is then replaced in position on the alignment keys and attached thereto by, for example, tightening the thumb screw into the mandrel screw to secure the holder to the plug. The holder may be easily removed by loosening the thumb screw without disturbing the plug mounted in the hole. The alignment means between the plug and holder insure that when the holder is remounted, it always returns to the same position with respect to the weapon.

In still further detail, the entire assembly may be removed from the weapon by first detaching the holder and then loosening the mandrel screw part way and rapping the mandrel screw to drive the mandrel back out of contact with the interior sidewall of the cavity. This allows the plug sidewalls to return to their position before they were forced out by the mandrel and the plug may then be easily removed from the mounting hole. The holder thumbscrew may be used to facilitate driving the mandrel back away from its tightened position.

As used herein, the words "alignment key(s)" are intended to refer to any means for aligning two separable pieces in predetermined relationship. Non-limiting examples of such alignment keys are pins and mating holes, ridges and mating grooves, and protrusion and mating depressions. When engaged the alignment keys should at least prevent translation and rotation in a plane perpendicular to the boresight.

BRIEF DESCRIPTION OF THE DRAWINGS

FIG. 6A is an exploded side view in simplified form of part of the apparatus of FIG. 4;

FIGS. 6B is an end view looking from the left toward the left-most piece of the exploded view of FIG. 6A;

FIGS. 6C is an end view looking from the left toward the center piece of the exploded view of FIG. 6A;

FIG. 6D is an end view looking from the right toward the right-most piece of the exploded view of FIG. 6A.

FIG. 7 is a simplified cross-sectional and partial cut-away view of the elements of FIG. 6 when assembled to the weapon.

DETAILED DESCRIPTION OF THE DRAWINGS

Figure 1:
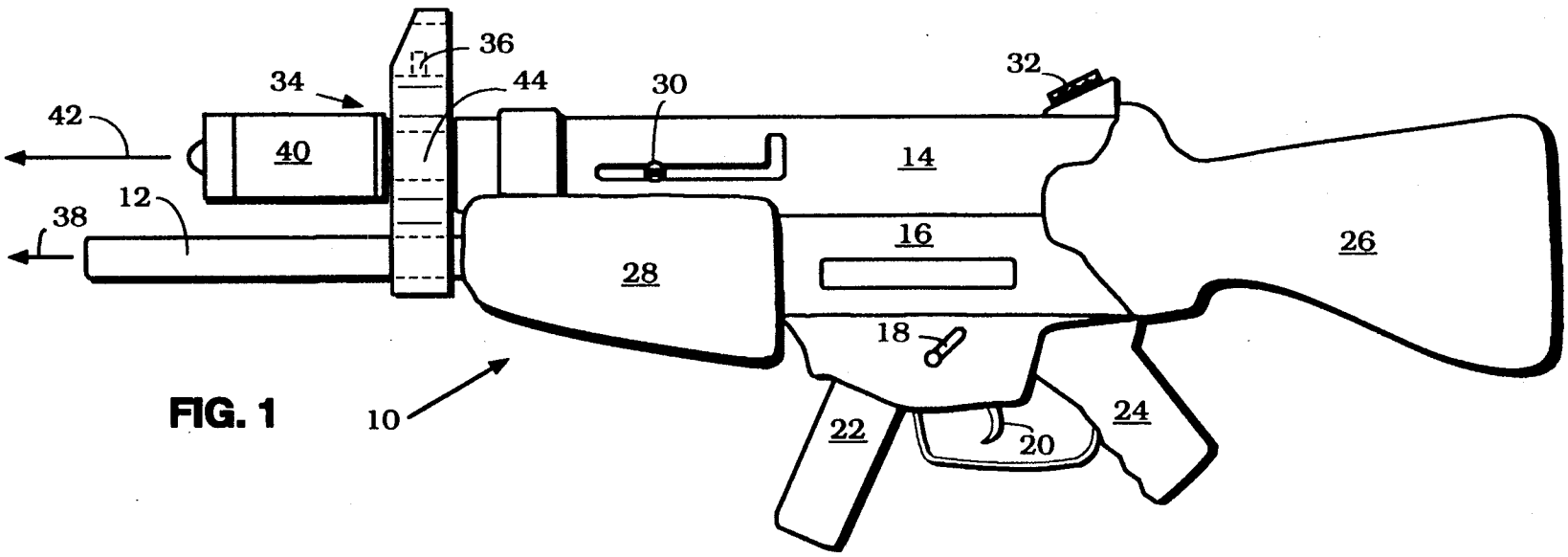
FIG. 1 is a simplified side view of weapon with a combination front sight and accessory mount.
Figure 4:
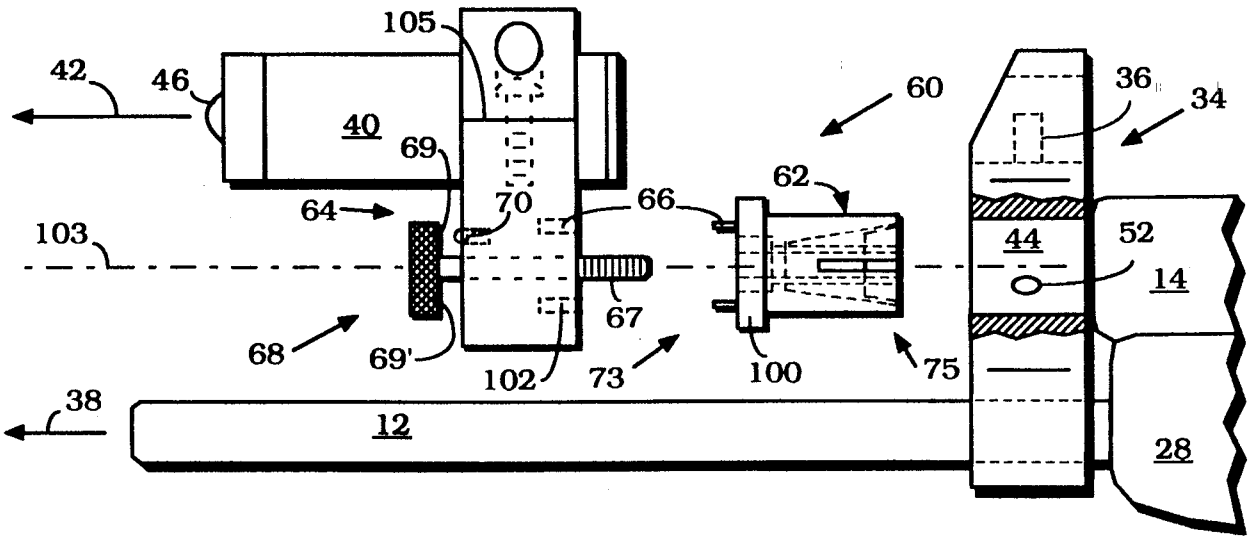
FIG. 4 is an exploded side and partial cut-away view in simplified form of an accessory mounting apparatus according to a first embodiment of the present invention.
Figure 2:
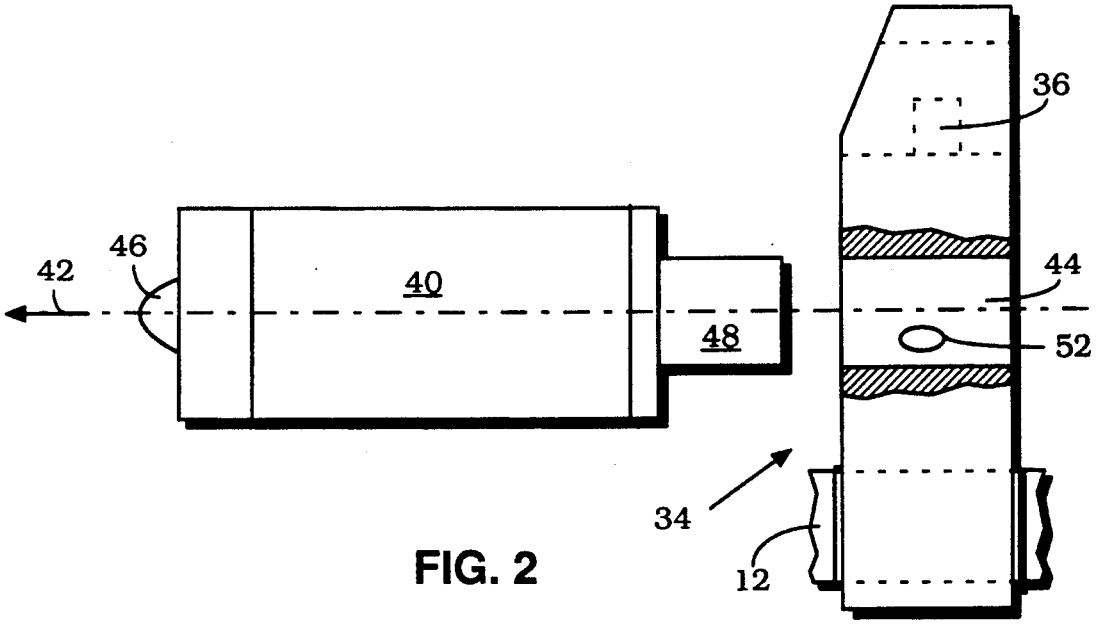
FIG. 2 is an exploded side and partial cut-away view of a laser sight attached to the mount of FIG. 1.
Figure 3:
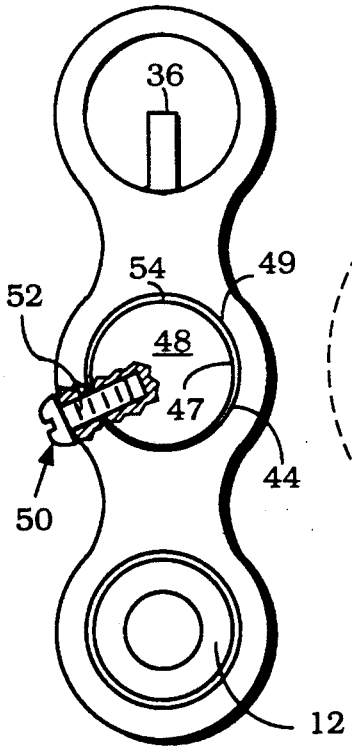
FIG. 3 is a front view of the mount of FIG. 2.

Referring now to FIG. 4 which shows in simplified form, a partially exploded side and partially cut-away view of accessory mounting apparatus 60 according to a preferred embodiment of the present invention. Apparatus 60 comprises plug portion 62 which is intended to be installed in mounting hole 44 of accessory mount 34 of weapon 10, and accessory holder portion 64 in which is mounted, for example, laser sight accessory 40 (or any other accessory). Accessory holder 64 is desirably split into two pieces joined by screws, for example along line 105 so that accessories of varying size may be accommodated and clamped firmly in holder 64.

Once plug means 62 is clamped in hole 44, holder portion 64 with or without accessory 40 may be attached or detached with ease and, by virtue of alignment means 66 in plug 62 and holder 64, returned to the same relative location. Thumb screw or other coupling means 68 is provided for clamping holder 64 to plug 62 by means of threaded shank 67 or other locking means. Detents 69 and spring loaded retracting ball 70 are included to provide temporary rotation stops on coupling means 68 when tightened to inhibit its loosening accidentally. While detents 69 are shown as being located in face 69' of knurled thumb wheel or screw 68, and captured spring loaded ball 70 in face 70' of holder 64, their locations may be reversed or other rotation detent arrangements well known in the art may also be used.

Figure 5:
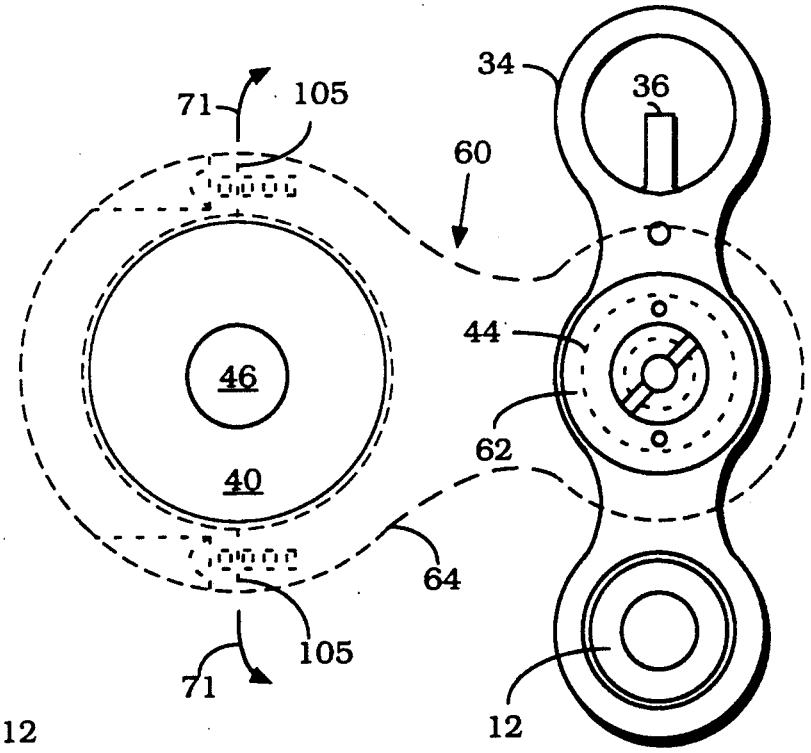
FIG. 5 is a front view of part of the assembly of FIG. 4.

FIG. 5 is a front view of part of assembly 60 of FIG. 4 showing plug 62 mounted in hole 44. Thumb wheel 68 has been omitted and holder 64 is shown dashed. Arc 71 indicates how the angular orientation of assembly 60 may be varied before plug 62 is tightened in hole 44.

FIG. 6 is an exploded side view of plug 62 with front views of the individual pieces. FIG. 7 is a cross-sectional and partially cut-away view showing plug 62 installed in hole 44. Plug 62 has substantially cylindrical portion 72 terminated by larger diameter flange 74 at first end 73 thereof and having cavity 76 extending into plug 62 from opposite second end 75. Between cavity 76 and outer surface 78 is sidewall 80. Outer surface 78 of diameter 79 is desirably cylindrical while inner surface 82 of sidewall 80 is tapered so as to have a decreasing inner diameter 81 as one moves away from end 75 toward end 73.

Plug 62 also comprises mandrel 84 with tapered outer perimeter 85 and thickness 86. Mandrel 84 has larger diameter 87 about equal inner diameter 81 of cavity 76 at end 75 Sidewall 80 and mandrel 84 preferably have about a one degree taper, but larger and smaller values may also be used.

Mandrel 84 desirably has female threaded hole 88 therethrough which mates with male threads 90 on mandrel tightening screw 92. Mandrel screw 92 has a shoulder or flange 93 which mates with corresponding recess 94 in end 73 of plug 62. Screwdriver slot 95 is conveniently provided in mandrel screw 92 to facilitate turning screw 92 relative to mandrel 84 to pull mandrel 84 into cavity 76 thereby radially expanding sidewalls 80, forcing them outward against interior bore 49 of hole 44. Because a low taper angle is used (e.g., about one degree) and because the contact area between surface 85 of mandrel 84 and interior surface 82 of cavity 76 is larger than the contact area between screw flange 93 and mating recess 94 in plug 62, mandrel 84 tends not to rotate when screw 92 is turned. Thus, mandrel 84 may be pulled into cavity 76 by turning screw 92 without providing any separate rotation resistant means for mandrel 84, although this is not precluded. Screw 92 desirably has interior threaded hole 97 accessed through flange 93. This threaded hole need not extend through the entire length of screw 92, although that is not precluded. Threaded hole 97 is intended to receive the threaded shank 67 of thumb screw 68 so that plug 62 and accessory holder 64 may be coupled together after plug 62 is installed in hole 44.

Wall 80 of plug 62 desirably has slots 98 therein, at least one, and conveniently three or six or more. About four is preferred but more or less may be used. The larger the number of slots the easier it is to radially expand the plug wall so that more of it contacts surface 49 of hole 44, but if too many slots are used the wall segments between the slots become narrower and it becomes easier to twist the plug by circumferential deflection of the wall segments.

Where multiple slots 98 are used, they are preferably substantially uniformly spaced around the circumference of wall 80. Slots 98 desirably extend longitudinally about the depth of cavity 76, although this is not essential. The purpose of slots 98 is to allow the portions of wall 80 between slots 98 to bend or flex radially outward into contact with interior surface 49 of hole 44 as mandrel 84 is pulled into cavity 76, and then return to their original position when mandrel 84 is removed. Thus, slots 98 should be long enough for that purpose.

It is desirable that the largest possible contact area be provided between wall 80 and surface 49 of hole 44, and that plug 62 have great resistance to torsional twisting about its longitudinal axis, that is, axis 103 extending between ends 73, 75. Accordingly it is preferred to have the area of the portions of wall 80 between slots 98 be greater than the area of the slots. Outer diameter 79 of sidewall 80 should be equal or less than the smallest expected value of inner diameter 99 of hole 44.

Plug 62 conveniently has alignment pins 100 installed therein which mate with corresponding alignment holes 102 in accessory holder 64. While this is the preferred arrangement, those of skill in the art will understand that pins 100 could be located in holder 64 and holes 102 in plug 62 or one pin in plug 62 and one pin in holder 64 with corresponding holes in the other, and/or that many other alignment arrangements may be used. It is only important that the alignment means prevent relative rotation and translation between plug 62 and holder 64 when assembled.

The arrangement and dimensions shown in Table I are suitable for accessory mounting holes on H&K weapons. Dimensions are in inches. Those of skill in the art will understand based on the teachings herein how to adjust the dimensions of the various components to fit accessory mounting holes on other weapons.

TABLE I

| | |
|---|---|
| * H & K mounting hole nominal ID | 0.49–0.492 |
| * H & K mounting hole nominal depth | 0.47 |
| * Plug OD at end 75 | 0.488–0.49 |
| * Plug OD at flange 74, end 73 | 0.9 |
| * Cavity ID at end 75 | 0.74 |
| * Wall 80 thickness at end 75 | 0.25 |
| * Wall and mandrel taper | 1 degree |
| * Cavity depth | 0.3 |
| * Flange 74 thickness | 0.05 |
| * Slot 98 length | 0.3 |
| * Slot 98 width | 0.04 |
| * Number of slots | 3–6 |
| * Mandrel thickness 86 | 0.2 |
| * Mandrel screw 92, male thread 90 | ⅜–16 |
| * Mandrel screw 92, female thread 97 | ¼–28 |
| * mandrel screw 92, shoulder 93 diameter | 0.49 |
| * Mandrel screw 92, shoulder 93 thickness | 0.1 |
| * Alignment pins 100 diameter | 0.125 |

The above-described accessory attachment apparatus is preferably made of readily machined stainless steel or aluminum or a combination thereof, although other metals or plastics and loaded plastics may also be used. Because of their superior strength, metals provide a more robust mount.

It will be apparent to those of skill in the art having read the foregoing description, that the present invention has the advantage of providing a weapon accessory mounting assembly that makes a large area, substantially evenly circumferentially spaced contact with the interior of the mounting hole, so that a large frictional force is obtained which couples the assembly rigidly to the weapon. The invented arrangement is therefore particularly robust and resistant to misalignment through shock and bumps.

It will be further apparent that the present invention has the advantage of providing separable pieces; a mounting plug for rigid attachment to the weapon and an accessory holder for rigidly retaining the accessory, which may be easily detached by hand and reassembled into a precisely predetermined position by means of coupling means and alignment keys extending therebetween. This substantially reduces the need to realign the accessory (e.g., a laser sight) after reattachment to the weapon.

It will be still further apparent that the present invention has the advantage of permitting many different accessory holders containing different accessories to be quickly attached to or detached from the weapon with highly precise and repeatable positioning without any sacrifice in the robustness of attachment.

A further advantage of the present accessory holder assembly is that it may be used without modification of the weapon and can fit a wide variety of weapons having similar mounting holes. The above-described advantages are obtainable simultaneously.

While the present invention has been described in terms of attaching accessories to the standard mounting hole of a H&K weapon, those of skill in the art will understand that it is not so limited and that the arrangement described herein may be used in connection with a wide variety of weapons made by H&K and others and which have other size and shape accessory mounting holes. Further, while the present invention has been described for convenience of understanding as utilizing various screws and threads for attaching the various elements of the design together and detents and captured spring loaded balls for providing click-rotational stops, other arrangements can also be used. Accordingly, it is intended to include these and other modifications and variation as will occur to those of skill in the art in the claims that follow.

I claim:

1. Accessory mounting means for a weapon having a cylindrical accessory mounting hole of a predetermined inner first diameter and first depth, comprising:

a radially expandable plug for demountable attachment to the weapon mounting means in the mounting hole; and an accessory holder coupled to the plug in predetermined relation for holding an accessory desired to be attached to the weapon.

2. The accessory mounting means of claim 1 further comprising alignment means extending between the plug and the holder for providing a predetermined orientation therebetween when assembled.

3. The accessory mounting means of claim 2 further comprising means for rigidly fixing together the plug and holder without use of tools.

4. The accessory mounting means of claim 1 wherein the plug has an outer second diameter less than or equal the inner first diameter and wherein the plug is hollow with a cavity extending therein from a first end thereof, thereby forming a radially expandable wall between the cavity and the outer second diameter.

5. The accessory mounting means of claim 4 wherein the plug further comprises a spreading mandrel for radially expanding the wall.

6. The accessory mounting means of claim 5 wherein the wall has an inner third diameter at the open end, and wherein the cylindrical wall comprises one or more longitudinal slits.

7. The accessory mounting means of claim 6 wherein the wall is tapered so that the inner third diameter decreases in a direction away from the open end, and wherein the spreading mandrel has a substantially matching taper.

8. The accessory mounting means of claim 7 wherein the taper is about one degree.

9. The accessory mounting means of claim 8 wherein the tapered mandrel has an outer fourth diameter at a larger diameter end thereof and wherein the fourth diameter about equals the third diameter at the open end of the cavity.

10. The accessory mounting means of claim 1 wherein the plug comprises one or more thin wall sections extending longitudinally at least part way from a first toward a second, opposed end of the plug, wherein the thin wall sections have an outer second diameter and an inner third diameter less than the second diameter, wherein the thin wall sections taper in thickness from the first toward the second end at a predetermined taper angle, and wherein the plug further comprises a tapered mandrel for engaging the tapered wall sections and, on advancing from the first toward the second end of the plug, radially expanding at least the portion of the wall sections in contact with the mandrel.

11. The accessory mounting means of claim 10 further comprising tightening means bearing on the second end of the plug for pulling the mandrel from the first end toward the second end.

12. The accessory mounting means of claim 11 wherein the plug and holder are separable and the tightening means has a threaded outer surface that engages matching threads in the mandrel for drawing the mandrel into the plug, and a threaded axial hole for receiving a threaded portion of a screw for demountably attaching the holder to the plug.

13. The accessory mounting means of claim 12 further comprising alignment means engaging the second end of the plug and the holder for locating the holder in a predetermined relationship to the plug.

14. The accessory mounting means of claim 13 wherein the alignment means comprises one or more protrusions and matching recesses in one or the other of the plug and the holder.

15. Accessory mounting means for a weapon having a cylindrical accessory mounting hole of a predetermined first inner perimeter and first depth, comprising:

radially expandable plug means able to press tightly against at least three substantially evenly spaced locations on the inner perimeter for demountable attachment of the plug means to the weapon; and accessory holding means coupled to the plug means in predetermined relation for holding an accessory desired to be attached to the weapon.

16. The accessory mounting means of claim 15 further comprising flange means at one end of the plug means for bearing against a face of the weapon adjacent an end of the mounting hole to limit penetration of the plug means into the mounting hole.

17. Accessory mounting means for a weapon having a cylindrical accessory mounting hole of a predetermined first inner perimeter and first depth, comprising:

radially expandable plug means able to press tightly against substantially evenly spaced locations on the inner perimeter for demountable attachment of the plug means to the weapon;

separable accessory holding means for holding an accessory desired to be attached to the weapon; and hand operable coupling means for coupling the plug means and holding means in predetermined relationship without tools.

18. The accessory mounting means of claim 17 wherein the coupling means comprises a hand operable thumb screw for attaching the plug means and holding means and two point alignment means engaging the plug means and holding means.

19. The accessory mounting means of claim 18 wherein the alignment means comprise at least two protrusions and matching cavities, wherein a protrusion is part of either the plug means or the holding means and a matching cavity is part of the other.

20. The accessory mounting means of claim 19 wherein the thumb screw comprises detent means for providing positive rotational positions of the thumb screw to inhibit unintentional loosening of the thumb screw.

* * * * *